US008476562B2

(12) United States Patent
Swanson

(10) Patent No.: US 8,476,562 B2
(45) Date of Patent: Jul. 2, 2013

(54) INDUCTIVE HEATER HUMIDIFIER

(75) Inventor: Cal Swanson, St. Louis, MO (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 453 days.

(21) Appl. No.: 12/794,571

(22) Filed: Jun. 4, 2010

(65) Prior Publication Data

US 2011/0297668 A1 Dec. 8, 2011

(51) Int. Cl.
*H05B 6/04* (2006.01)
*H05B 6/36* (2006.01)

(52) U.S. Cl.
USPC ..... 219/660; 219/672

(58) Field of Classification Search
USPC ..... 219/660, 672
See application file for complete search history.

(56) References Cited

U.S. PATENT DOCUMENTS

| | | | | |
|---|---|---|---|---|
| 4,371,768 | A * | 2/1983 | Pozna | 219/633 |
| 4,792,652 | A * | 12/1988 | Seguy et al. | 219/624 |
| 5,053,593 | A | 10/1991 | Iguchi | |
| 5,222,185 | A | 6/1993 | McCord, Jr. | |
| 5,286,942 | A | 2/1994 | McFadden et al. | |
| 5,450,305 | A * | 9/1995 | Boys et al. | 363/24 |
| 5,525,782 | A | 6/1996 | Yoneno et al. | |
| 5,801,359 | A | 9/1998 | Mano et al. | |
| 6,008,482 | A | 12/1999 | Takahashi et al. | |
| 6,040,564 | A | 3/2000 | Ueda et al. | |
| 6,084,225 | A * | 7/2000 | Schmitt | 219/672 |
| 6,320,169 | B1 | 11/2001 | Clothier | |
| 6,335,517 | B1 | 1/2002 | Chauviaux | |
| 6,668,151 | B2 | 12/2003 | Uehara et al. | |
| 6,681,998 | B2 | 1/2004 | Sharpe et al. | |
| 6,770,857 | B2 | 8/2004 | Hiruta et al. | |
| 6,844,533 | B1 * | 1/2005 | Chuang | 219/604 |
| 2003/0020586 | A1 * | 1/2003 | Uehara et al. | 336/229 |
| 2003/0230567 | A1 | 12/2003 | Centanni et al. | |
| 2004/0037597 | A1 | 2/2004 | Haseba et al. | |
| 2007/0108201 | A1 | 5/2007 | Vinegar et al. | |
| 2008/0217321 | A1 | 9/2008 | Vinegar et al. | |
| 2010/0147299 | A1 * | 6/2010 | Row et al. | 128/203.27 |

FOREIGN PATENT DOCUMENTS

| | | |
|---|---|---|
| EP | 1055884 | 5/2000 |
| EP | 1978786 | 10/2008 |
| JP | 7318119 | 12/1995 |
| JP | 2000-346409 | 12/2000 |
| JP | 2001161564 | 6/2001 |
| JP | 2001174009 | 6/2001 |
| JP | 2009079887 A | 4/2009 |
| WO | 96/13138 | 5/1996 |
| WO | 2007/101298 | 9/2007 |
| WO | 2008/054070 | 5/2008 |

* cited by examiner

*Primary Examiner* — Lex Malsawma
(74) *Attorney, Agent, or Firm* — Brinks Hofer Gilson & Lione

(57) ABSTRACT

An inductive heater humidifier for heating fluids is provided by the present disclosure. The humidifier includes a reservoir having a ferromagnetic bottom plate. The reservoir is disposed on top of a non-metallic cover plate, which rests on a topless ferrite base. The ferrite base includes induction coil for generating heat. The induction coil is energized to produce eddy currents that generate heat, which is convectively transferred to the reservoir via the bottom plate to heat fluid in the reservoir.

23 Claims, 7 Drawing Sheets

INDUCTIVE HEATER HUMIDIFIER

FIELD

The present disclosure relates to inductive heating, and more particularly, an inductive heater humidifier.

BACKGROUND

The statements in this section merely provide background information related to the present disclosure and may not constitute prior art.

Induction heating such as eddy current heating refers to the process of heating an electrically conductive material such as a metal, metal compound, or metal alloy by inducing circulating currents therein from a proximate alternating magnetic field. Hysteretic heating is another form of induction heating that results from alternating the magnetic domains in a strong magnetically susceptible material such as iron, nickel, cobalt, and alloys thereof, as well as compounds containing their oxides also by proximity to an alternating magnetic field. When the magnetic susceptibility of an electrically conductive material is small, heating is primarily generated by eddy currents, and the magnetic flux path is usually not significantly altered by the conductive material. When the magnetic susceptibility of an electrically resistive compound is large, heating is primarily hysteretic, and stray magnetic fields may be reduced by a low reluctance path that can channel a significant portion of the magnetic flux through the magnetic material. For ferromagnetic materials that exhibit both high electrical conductivity and strong magnetic susceptibility, both eddy current and hysteretic heating occur together.

When done properly, a hysteretic heating solution should have less stray magnetic field than a solely eddy-current solution because the magnetic flux flowing through a ferromagnetic material with high magnetic permeability such as iron will tend to travel through the low reluctance path provided by the magnetic material as long as the flux it contains is well within the saturation limits of the material so that it remains highly permeable.

An induction heater generally consists of an electromagnet, through which a high-frequency alternating current (AC) is passed. Induction heaters may be used in numerous applications such as forming, annealing, and welding metals. Induction heating systems have also been employed for heating water to produce steam for humidification purposes. Such humidifying systems, however, generally include many intervening thermal layers that impede the transfer of heat from the heater to the body of water or large masses with relatively small surface area. Consequently, these systems may operate with drawbacks to conventional heaters in that they take longer to heat their intended target or are unable to transfer as much heat to the target, thereby increasing heating costs and reducing the potential efficiency of the solution.

SUMMARY

The present disclosure generally comprises an inductive heater humidifier. According to one aspect, the humidifier includes a topless ferrite base including a peripheral sidewall and a central core, wherein a cavity is disposed between the peripheral sidewall and the central. The ferrite base is formed of a ferrous oxide having a transition metal element. Magnetic coil within the coil is wound around the central core to form an induction coil for generating heat. The humidifier further includes a non-metallic cover plate disposed on top of the ferrite base. A reservoir for storing fluid is provided and includes a ferromagnetic base plate disposed on top of the cover plate. In operation, the induction coil is energized to produce and target eddy currents in the ferromagnetic base that generate heat, wherein the heat is convectively transferred to the reservoir via the base plate to heat the fluid.

According to another aspect, an inductive heater is provided that comprises a ferrite base defining a peripheral sidewall, a central core, and a cavity disposed between the peripheral sidewall and the central core. The ferrite base includes a ferrous oxide having a transition metal element. Magnetic wire is disposed within the cavity and wound around the central core to form an induction coil. The heater further comprises a non-metallic cover plate that rests on top of the ferrite base. In operation, the induction coil is energized to produce and target eddy currents and alternating magnetic polarizations in the ferromagnetic base that generate heat, wherein the heat is convectively transferred to a target through the cover plate.

According to yet another aspect, an inductive heater is provided that comprises a ferrite base formed of a ferrous oxide having a transition metal element. The ferrite base defines a bottom portion, a peripheral sidewall extending from the bottom portion, an exposed upper portion, a central core, and a cavity disposed between the peripheral sidewall and the central core. Magnetic wire is disposed within the cavity and wound around the central core to form an induction coil. In operation, the induction coil is energized to produce eddy currents and alternating magnetic polarizations that generate heat, wherein the heat is convectively transferred to a target through the exposed upper portion.

According to still yet another aspect, a method of operating an induction heater humidifier is provided. The method includes energizing an induction coil disposed within a ferrite base, and directing heat generated from the induction coil to a reservoir base. The method further includes restricting the operating temperature of the induction heater humidifier to below a ferromagnetic curie point of the reservoir base in order to oscillate magnetic domains within the bottom plate to generate additional heat.

Further aspects of the present disclosure will be in part apparent and in part pointed out below. It should be understood that various aspects of the disclosure may be implemented individually or in combination with one another. It should also be understood that the detailed description and drawings, while indicating certain exemplary forms of the present disclosure, are intended for purposes of illustration only and should not be construed as limiting the scope of the disclosure.

DRAWINGS

The drawings described herein are for illustration purposes only and are not intended to limit the scope of the present disclosure in any way.

It should be understood that throughout the drawings corresponding reference numerals indicate like or corresponding parts and features.

DETAILED DESCRIPTION

The following description is merely exemplary in nature and is not intended to limit the present disclosure or the disclosure's applications or uses.

Figure 1:
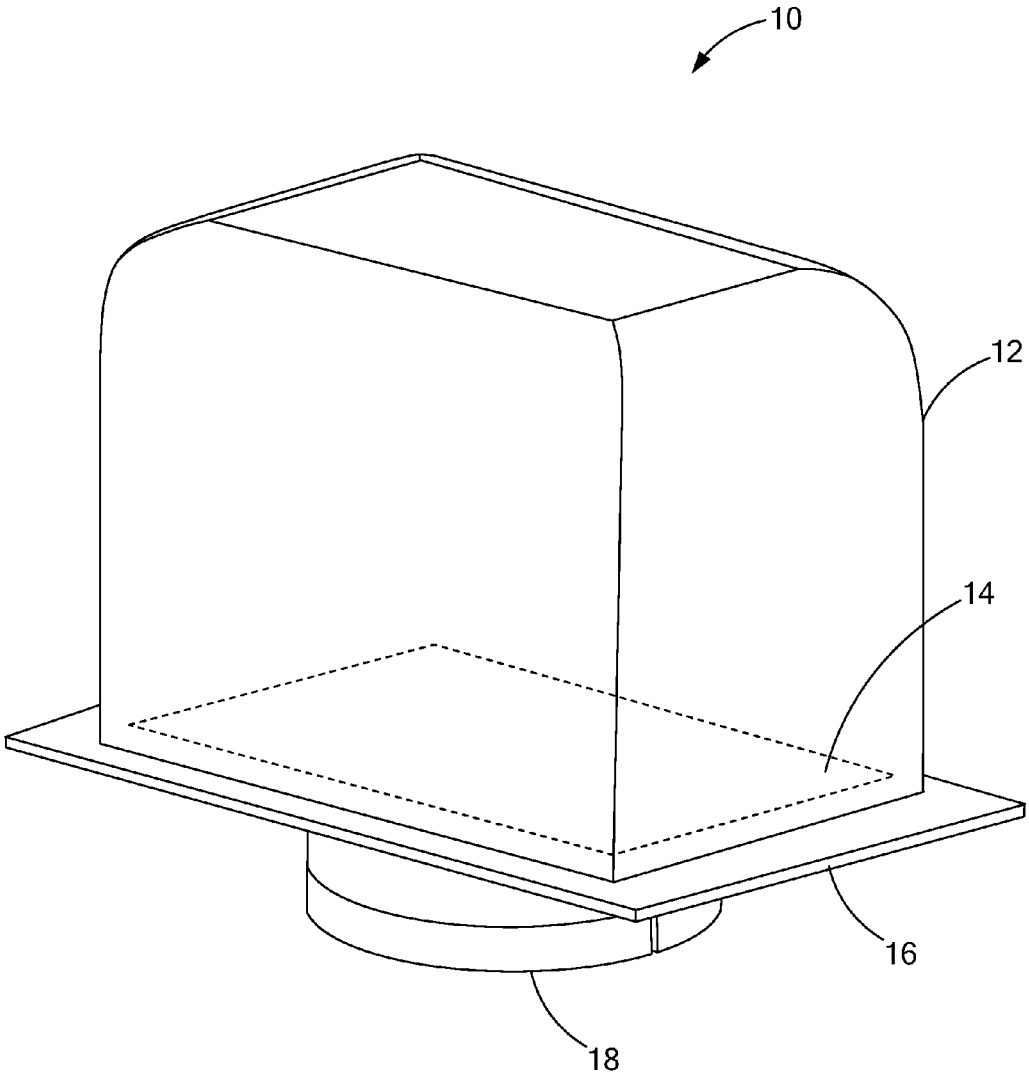
FIG. 1 is a perspective view of a inductive heater humidifier in accordance with the present invention.

Referring to FIG. 1, an inductive heater humidifier embodying the principles of the present application is illustrated therein and designated at 10. The humidifier 10 comprises a reservoir 12 for storing fluid such as water. The reservoir 12 includes a removable bottom plate 14 composed of a ferromagnetic material such as, but not limited to, stainless steel (e.g., 430 stainless steel), iron, cobalt, nickel, and/or alloys thereof. The bottom plate 14 may include a biocompatible coating such as Titanium Dioxide ($TiO_2$) and is disposed on a non-metallic cover plate 16 resting on a topless ferrite base 18. The cover plate 16 may be composed of glass and/or various polymers such as acrylic.

The ferrite base 18 is composed of a material exhibiting hysteretic low energy losses at high frequencies. According to one aspect, the ferrite base 18 is composed of a sintered powdered ferrite. Preferably, the ferrite base 18 is composed of a material having high magnetic permeability to provide a path of least resistance for a magnetic flux. The ferrite base 18 may be composed of an electrically non-conductive material, or a material having low electrical conductivity such that eddy currents are sufficiently minimized. To illustrate, the ferrite base 18 should include a material having a magnetization that can easily reverse direction without dissipating much energy (hysteresis losses), and having a high resistivity to prevent eddy currents in the core. Furthermore, the ferrite base 18 may include a ferrous oxide having a transition metal such as, but not limited to, iron, nickel, manganese, or zinc. For instance, the ferrite base 18 may include a ferrite such as manganese-zinc (MnZn), which exhibits magnetic permeability at about 100°-150° Celsius at frequencies above about 20-100 kHz. The ferrite base 18 may also include a ferrite such as nickel-zinc (NiZn).

Figure 2:
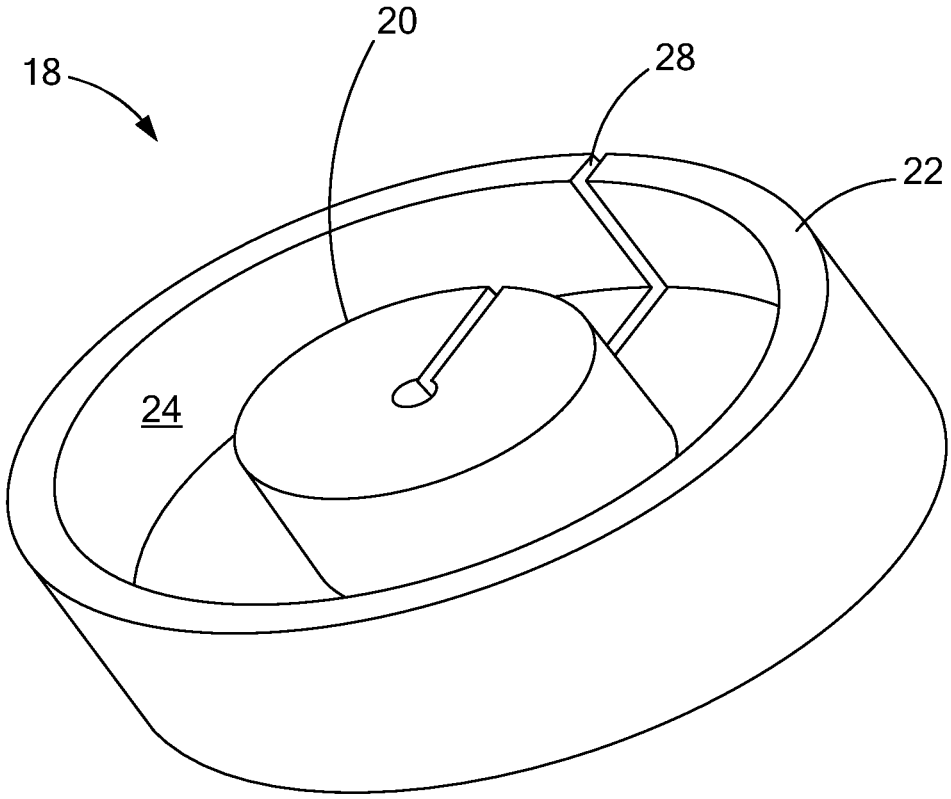
FIG. 2 is an exploded perspective view of a ferrite base shown in FIG. 1.
Figure 3:
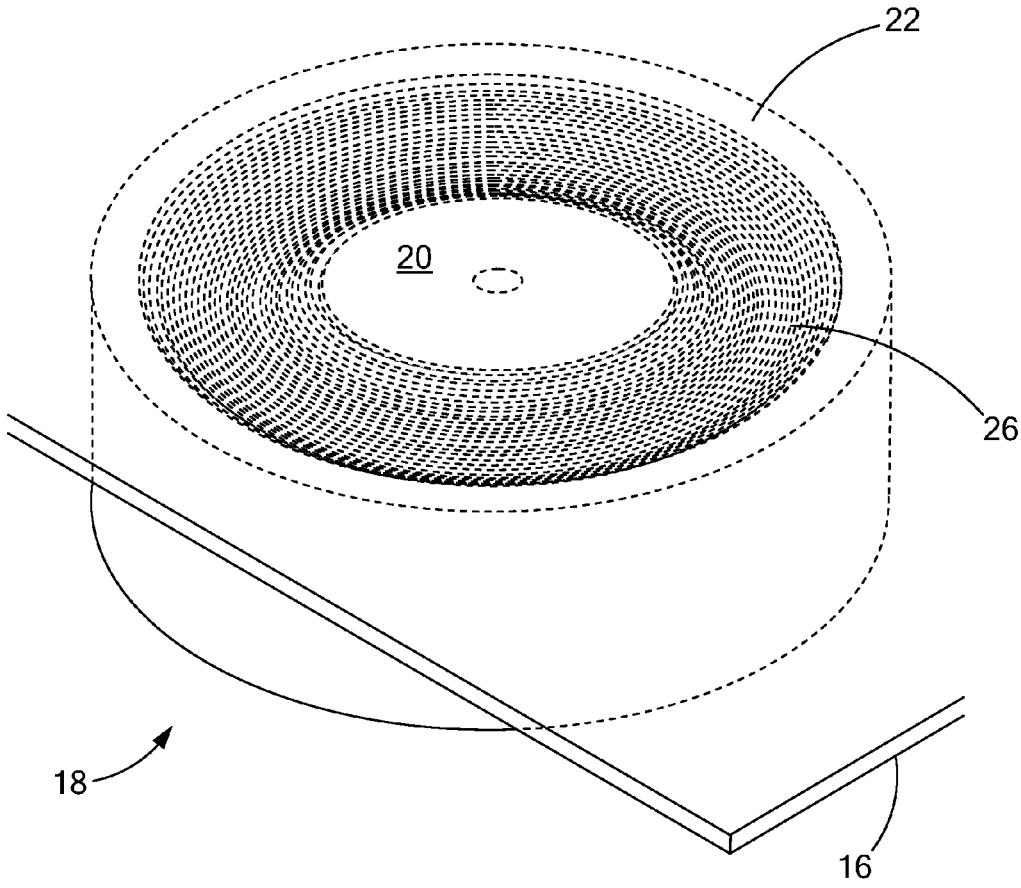
FIG. 3 is an exploded perspective view of the ferrite base with a cover plate thereon.

Referring now to FIGS. 2 and 3, the ferrite base 18 includes a central core 20 separated from a peripheral sidewall 22 to form a channel or cavity 24 there between. While the ferrite base 18 is shown in the drawings as being circular, it is to be understood that the ferrite base 18 may be of any suitable shape. The ferrite base 18 further includes insulated magnetic coil disposed within the cavity 24 and wound around the central core 20 to form an induction coil 26 for generating heat. As best shown in FIG. 2, the ferrite base 18 may include a slit 28 for managing the induction coil 26 and reducing eddy currents circulating in the ferrite.

As shown in FIG. 3, the height of the induction coil 26 may be such that it is flush against the bottom surface of the cover plate 16. Moreover, the ferrite base 18 encloses the induction coil 26 on all sides except that facing the cover plate 16, such that the induction coil 26 is sufficiently insulated. Although the insulation of the magnetic wire may be sufficient, those of skill in the art will appreciate that the induction coil 26 may be further covered with a thin protective layer for added insulation.

Figure 4:
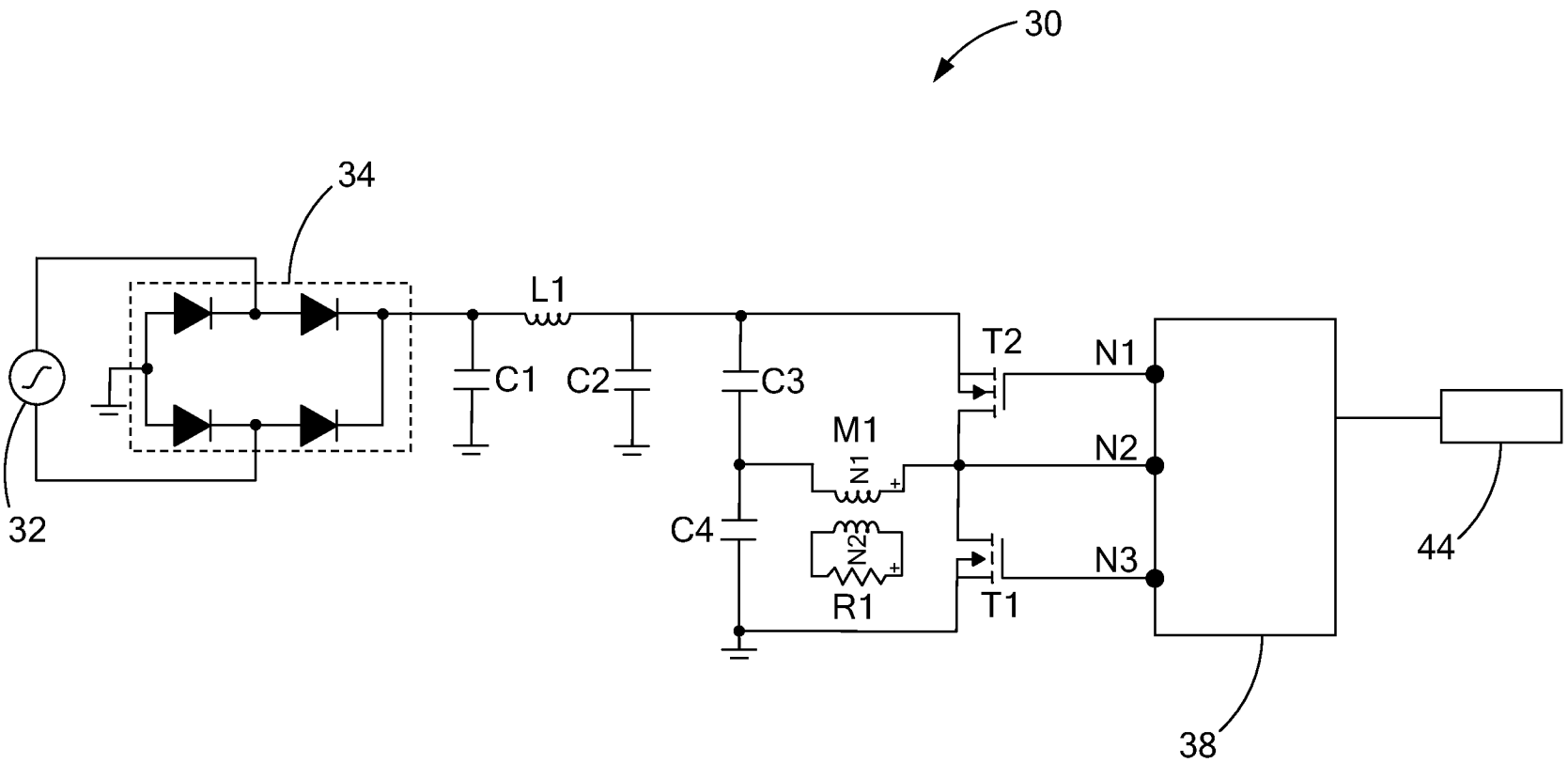
FIG. 4 is a schematic of an electrical circuit according to one form of the present invention.

Referring now to FIG. 4, an electrical circuit 30 according to one form of the present disclosure is shown. The electrical circuit 30 is operatively connected to the induction coil 26 (schematically depicted by components M1 and R1) and is operable to supply electrical current thereto. The electrical circuit 30 includes a power source 32 such as an unregulated DC power supply having full wave rectification of an AC line. The power source 32 is operable to pass power through a half-bridge rectifier 34, which is then filtered with one or more capacitors (e.g., C1-C4), an inductor L1, and/or a common-mode transformer M1, which may be connected to a resistor R1.

Additionally, the electrical circuit 30 includes a switching circuit including at least one switching element such as transistors T1 and T2. The transistors T1 and T2 may be metal-oxide-semiconductor field-effect transistors (MOSFETs), insulated gate bipolar transistors (IGBTs), or any other suitable semiconductor switching elements known to those of skill in the art. The transistors T1 and T2 are connected in series with the induction coil 26 and the DC power supply 32, and may be driven by any suitable control circuit 38.

Figure 5:
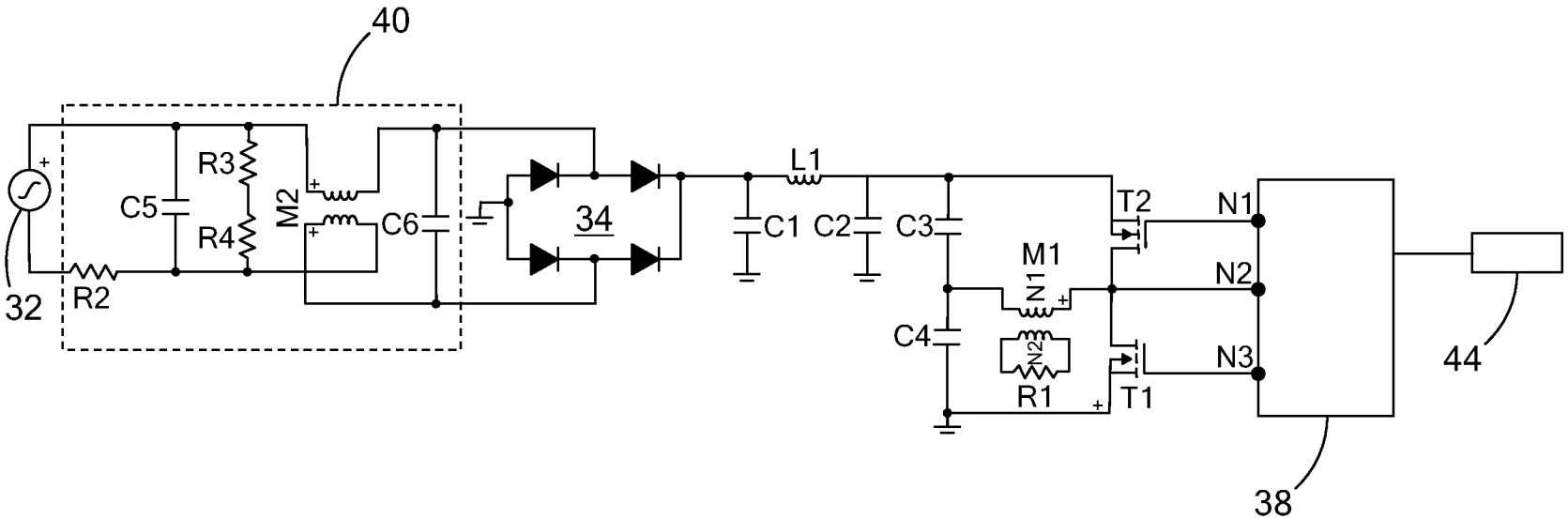
FIG. 5 is a schematic of the electrical circuit according to an alternative form of the present invention.

According to an alternative form of the present disclosure, the electrical circuit 30 further includes a power factor correction (PFC) circuit 40, as shown in FIG. 5. The PFC circuit 40 includes at least one capacitor (e.g., C5 and C6) and at least one resistor (e.g., R2-R4), which are electrically connected to a common-mode transformer M2. As will be understood to those of ordinary skill in the art, the PFC circuit 40 is operable to filter the input power prior to passing it through the rectifier 34.

Figure 6:
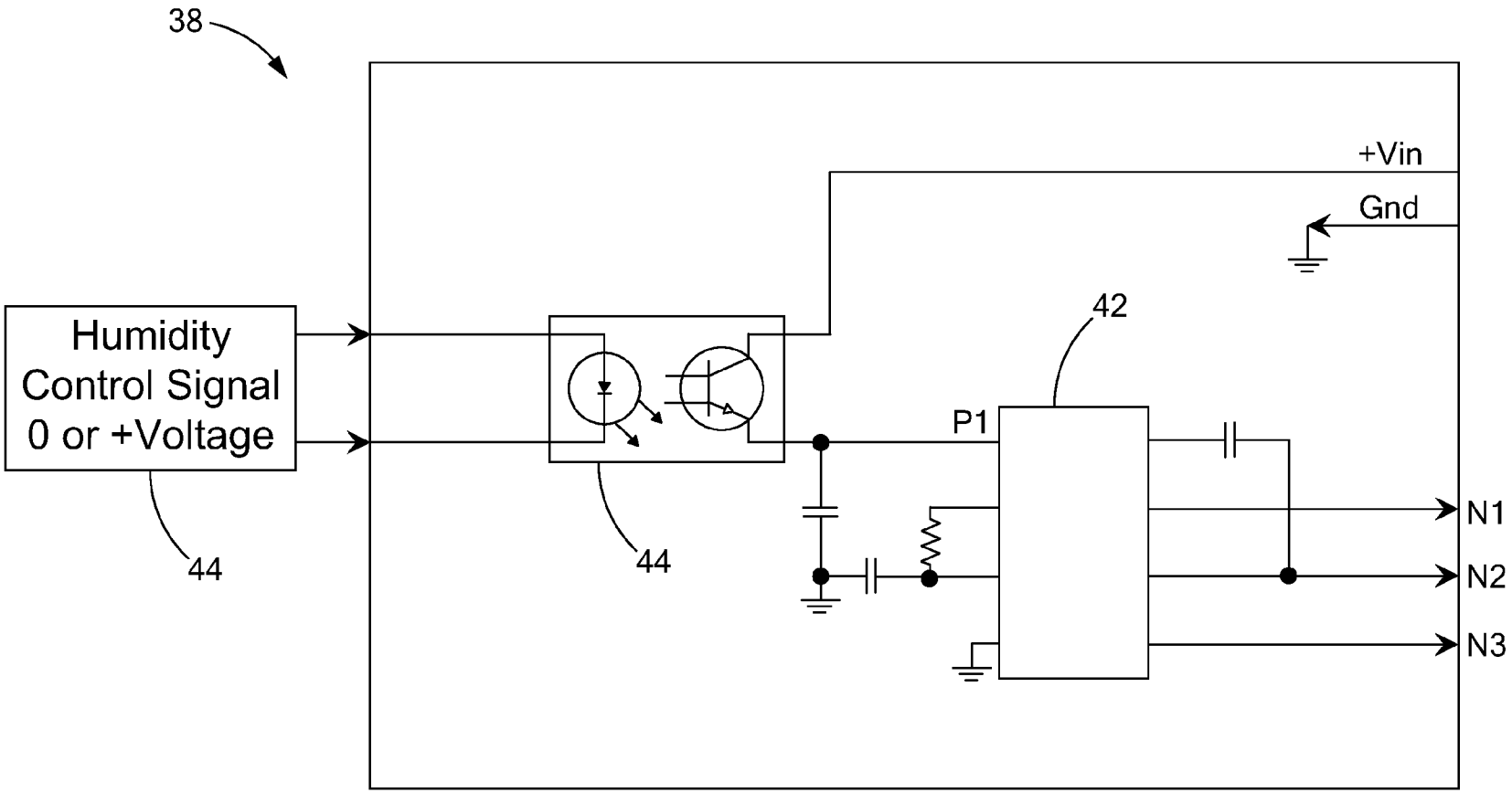
FIG. 6 is a schematic of a control circuit according to one form of the present invention.

Referring now to FIG. 6, a control circuit 38 according to one aspect of the present invention is shown. The control circuit 38 includes an oscillator 42 that interfaces with transistors T1 and T2 via nodes N1-N3. The control circuit 38 also includes an input 44 operable to communicate a control signal to pin P1 for powering the oscillator 42 on and off. In FIG. 6, an optoelectronic oscillator 46 is provided for communicating the control signal to the oscillator 42, yet those of ordinary skill in the art will appreciate that other suitable components such as a switch or relay may be employed for applying and removing power to pin P1. When the oscillator 42 is on, the oscillator 42 drives transistors T1 and T2, which sequentially fire signals to energize the induction coil 26.

It is to be understood that the electrical circuit 30 and control circuit 38 described above and shown in FIGS. 4-6 are merely intended for purposes of illustration, as those of ordinary skill in the art will appreciate that the electrical and control circuit 30 and 38 may employ various electrical components. Similarly, the electrical and control circuit 30 and 38 may include more or less capacitors, resistors, inductors, switching elements, etc. In addition, while the electrical circuit 30 is preferably controlled by a self-oscillating half-bridge driver such as that shown in FIG. 6, alternative controllers known in the art may be employed.

In operation, AC current received from the power source 32 is converted to DC using the rectifier 34. Of course, if the electrical circuit 30 includes a PFC circuit 40, then the AC current is filtered prior to being passed to through the rectifier 34. Otherwise, the DC current is filtered with at least one capacitor (e.g., C1-C4), inductor L1, and/or transformer M1, and eventually communicated to the switching circuit (T1 and T2 or RL1 and RL2) to be administered to the induction coil 26. Preferably, the current is supplied at a frequency outside the audible range of humans. Moreover, the input voltage of the power source 32 should be converted to a frequency tuned to the bottom plate 14 of the reservoir 12.

Once energized, the induction coil 26 generates eddy currents and alternating magnetic polarizations, which in turn, produce heat. More specifically, when the induction coil 26 is energized, magnetic flux circulates primarily in a path constrained by the ferrite central core 20 and the ferromagnetic bottom plate 14 above it, which is also magnetically permeable. Flux circulating through the bottom plate 14 produces heat because unlike the central core 20, the bottom plate 14 is composed of a material having high-loss properties. Since the bottom plate 14 is integral to the reservoir 12, it remains relatively cool while heat generated from eddy currents and hysteresis is efficiently transferred to the fluid within the reservoir 12 via convection. In addition, the exterior of the reservoir 12, including all surrounding structures, remain cool since they are not electrically conductive.

Figure 7:
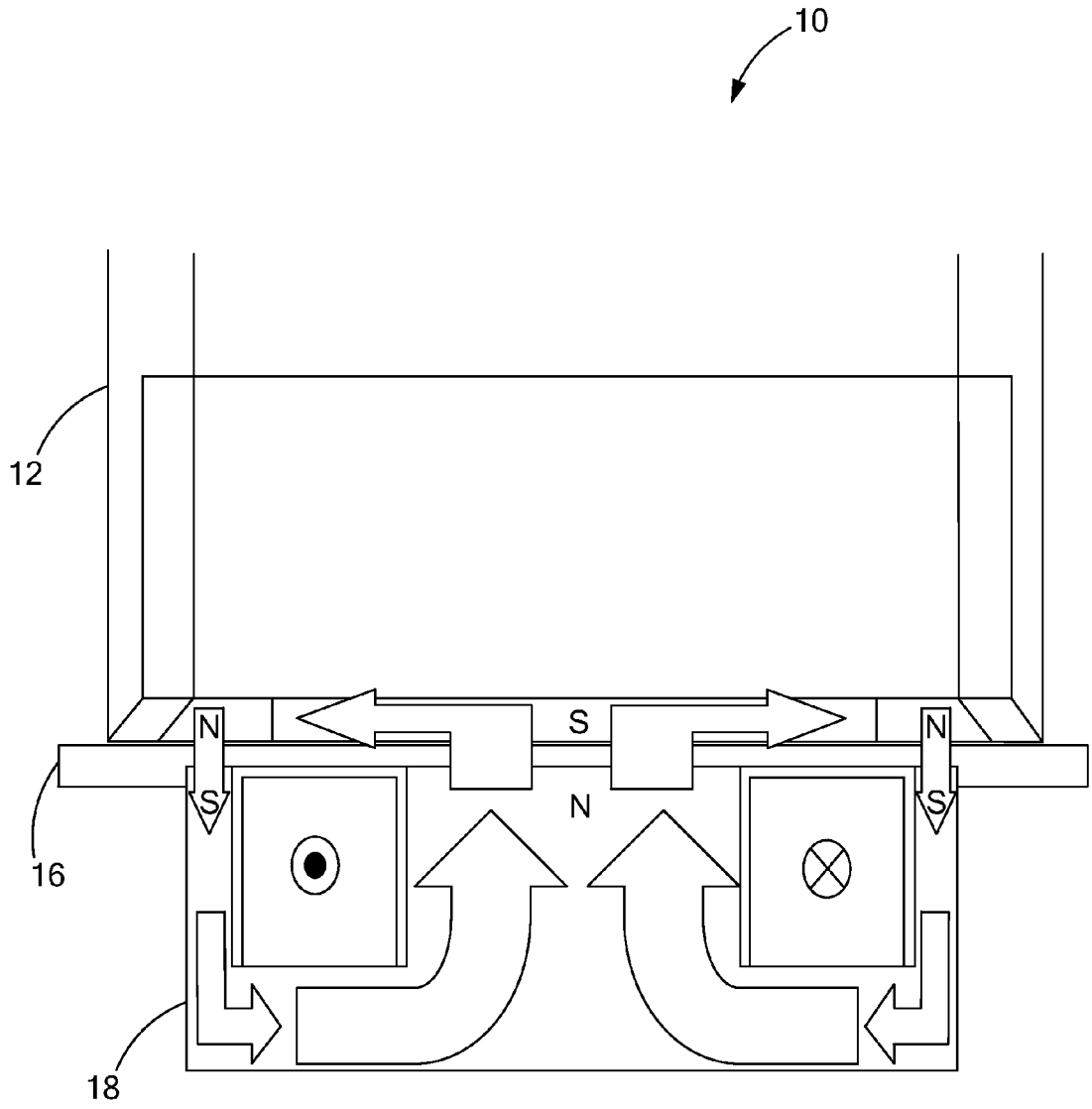
FIG. 7 is a perspective view of the inductive heater humidifier illustrating a magnetic flux path.

Although some flux may escape, the magnetic flux remains primarily in the ferromagnetic components (e.g., the ferrite base 18 and bottom plate 14) since the magnetic permeability of the ferrite base 18, the central core 20, and the ferromagnetic bottom plate 14 are much greater than any nearby materials. In addition, since the ferrite base 18 is composed of a magnetically permeable material, a path of least resistance is provided for the magnetic flux. As best shown in FIG. 7, the path of magnetic flux from the induction coil 26 flows upward through the center of the ferrite base 18, then outwards, and returns down through the sidewall 22 of the ferrite base 18 and back inwards towards the center.

As understood by those of skill in the art, efficient operation of the humidifier 10 is ensured by maximizing hysteretic and eddy current losses, while also minimizing stray magnetic fields and maintaining a cool central core 20. Furthermore, operation of the humidifier 10 should be restricted to temperatures below the ferromagnetic curie point of the bottom plate 14 of the reservoir so that magnetic domains within the bottom plate 14 are oscillated as well to produce additional heat.

According to another form of the present invention, a method of operating an induction heater humidifier 10 is provided. The method comprises energizing an induction coil 26 disposed within a ferrite base 18. As discussed above, the induction coil 26 may be energized using an electrical circuit 30 having a half-bridge rectifier 34 driven by a high frequency oscillator 38. Once energized, the induction coil 26 produces eddy currents and alternating magnetic polarizations. The method further includes directing the heat generated from the induction coil 26 to a reservoir base, such as the ferromagnetic bottom plate 14. Finally, the method includes restricting the operating temperature of the induction heater humidifier 10 to below a ferromagnetic curie point of the reservoir base in order to oscillate magnetic domains within the bottom plate 14 to generate additional heat.

As will be appreciated by those of skill in the art, the present disclosure provides an induction heater humidifier capable of rapid heating and transferring considerable power to a target to be heated without generating excessive temperature in the exciter. By converting electrical power to heat a target (as opposed to a source), less energy may be consumed and heat losses may be minimized. Moreover, since the humidifier employs high frequency induction to transfer heat directly to a water reservoir, numerous thermal barriers that normally exist between self-contained heathers and the targeted objects may be eliminated. As such, the present disclosure helps achieve greater efficiency while reducing overall costs.

While the present disclosure has been discussed above with particular attention to an induction heater humidifier, it is to be understood that the teachings disclosed herein, including its various forms, is not limited to such an application and can be employed in any application to which a target is to be heated, and thus the application to induction heater humidifiers should not be construed as limiting the scope of the present disclosure.

When describing elements or features and/or forms of the present disclosure, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary forms and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that each process or step can be repeated more than once and that additional or alternative processes or steps may be employed and still be within the scope of the present disclosure.

What is claimed is:

1. An inductive heater humidifier comprising:

a ferrite base defining a peripheral sidewall, a central core, and a cavity disposed between the peripheral sidewall and the central core, the ferrite base being formed of a ferrous oxide having a transition metal element;

magnetic wire disposed within the cavity and wound around the central core to form an induction coil;

a non-metallic cover plate having a bottom surface and a top surface, the bottom surface of the cover plate disposed on top of the ferrite base; and a reservoir for storing fluid, the reservoir having a ferromagnetic bottom plate disposed on the top surface of the cover plate, the ferromagnetic bottom plate being formed of a material having a higher loss property than that of the ferrite base;

wherein the induction coil is selectively energized to produce eddy currents in a path constrained by the ferrite base and the ferromagnetic bottom plate and alternating magnetic polarizations that generate heat due to the higher loss property of the ferromagnetic bottom plate, the heat being convectively transferred to the reservoir via the ferromagnetic bottom plate to heat the fluid.

2. The humidifier according to claim 1, wherein the ferromagnetic bottom plate is composed of a material selected from the group consisting of iron, cobalt, and nickel.

3. The humidifier according to claim 1, wherein the ferromagnetic bottom plate includes a bio-compatible coating.

4. The humidifier according to claim 1, wherein the cover plate is selected from the group consisting of polymers and glass.

5. The humidifier according to claim 1, wherein the ferrous oxide exhibits magnetic permeability at about 100° C. at frequencies above about 20 kHz.

6. The humidifier according to claim 1, further comprising an electrical circuit operatively connected to the induction coil to supply electrical current to energize the induction coil.

7. The humidifier according to claim 6, wherein the electrical circuit includes an unregulated DC power supply having full wave rectification of an AC line, filtered with one of a capacitor, an inductor, and a common-mode transformer, and at least one switching semiconductor connected in series with the induction coil and the DC power supply and driven by a high frequency oscillator.

8. The humidifier according to claim 7 further comprising a power factor correction circuit.

9. The humidifier according to claim 7, wherein the electrical circuit includes a half-bridge rectifier driven by an oscillator.

10. An inductive heater comprising:

a ferrite base defining a peripheral sidewall, a central core, and a cavity disposed between the peripheral sidewall and the central core, the ferrite base being formed of a ferrite oxide having a transition metal element;

magnetic wire disposed within the cavity and wound around the central core to form an induction coil;

a non-metallic cover plate having a bottom surface and a top surface, the bottom surface of the cover plate disposed on top of the ferrite base; and a ferromagnetic bottom plate disposed on the top surface of the non-metallic cover plate and being formed of a material having a higher loss property than that of ferrite base, wherein the induction coil is selectively energized to produce eddy currents in a path constrained by the ferrite base and the ferromagnetic bottom plate and alternating magnetic polarizations that generate heat due to the higher loss property of the ferromagnetic bottom plate, the heat being convectively transferred to a target through the cover plate.

11. The inductive heater according to claim 10, wherein the cover plate is selected from the group consisting of polymers and glass.

12. The inductive heater according to claim 10, wherein the ferrous oxide exhibits magnetic permeability at about 100° C. at frequencies above about 20 kHz.

13. The inductive heater according to claim 10, wherein the ferrite base defines a circular configuration.

14. The inductive heater according to claim 10, wherein the induction coil is flush against the bottom surface of the non-metallic cover.

15. The inductive heater according to claim 10, further comprising an electrical circuit operatively connected to the induction coil to supply electrical current to energize the induction coil.

16. The inductive heater according to claim 15, wherein the electrical circuit includes an unregulated DC power supply having full wave rectification of an AC line, filtered with one of a capacitor, an inductor, and a common-mode transformer, and at least one switching semiconductor connected in series with the induction coil and the DC power supply and driven by a high frequency oscillator.

17. The humidifier according to claim 16 further comprising a power factor correction circuit.

18. The humidifier according to claim 16, wherein the electrical circuit includes a half-bridge rectifier driven by an oscillator.

19. An inductive heater comprising:

a ferrite base defining:

a bottom portion;

a peripheral sidewall extending from the bottom portion;

an exposed upper portion;

a central core;

a cavity disposed between the peripheral sidewall and the central core; and magnetic wire disposed within the cavity and wound around the central core to form an induction coil; and a ferromagnetic bottom plate disposed proximate the exposed upper portion and being formed of a material having a higher loss property than that of the ferrite base, the ferrite base being formed of a ferrous oxide having a transition metal element, and the induction coil being selectively energized to produce eddy currents in a path constrained by the ferrite base and the ferromagnetic bottom plate and alternating magnetic polarizations that generate heat due to the higher loss property of the ferromagnetic bottom plate, the heat being convectively transferred to a target through the exposed upper portion.

20. The inductive heater according to claim 19, wherein the ferrite base is sintered.

21. A method of operating an induction heater humidifier comprising:

energizing an induction coil disposed within a ferrite base;

circulating magnetic flux through the ferrite base and a reservoir bottom plate, the reservoir bottom plate being formed of a material having a higher loss property than that of the ferrite base;

directing heat generated from the induction coil to a reservoir base;

restricting an operating temperature of the induction heater humidifier to below a ferromagnetic curie point of the reservoir bottom plate in order to oscillate magnetic domains within the reservoir base to generate additional heat due to the higher loss property of the reservoir bottom plate.

22. The method according to claim 21, wherein the induction coil is energized by an electrical circuit having a half-bridge rectifier driven by an oscillator.

23. The method according to claim 21, wherein the magnetic flux path from the induction coil flows upward through a center of the ferrite base, then outwards, then down through a peripheral sidewall of the ferrite base, then inwards towards the center of the ferrite base.

* * * * *